US008333629B2

(12) United States Patent
McChesney et al.

(10) Patent No.: US 8,333,629 B2
(45) Date of Patent: Dec. 18, 2012

(54) SYSTEM AND METHOD FOR COOLING A MARINE OUTBOARD ENGINE

(75) Inventors: Richard McChesney, Waukegan, IL (US); George Broughton, Wadsworth, IL (US); Mark Noble, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 555 days.

(21) Appl. No.: 12/608,495

(22) Filed: Oct. 29, 2009

(65) Prior Publication Data

US 2010/0112877 A1 May 6, 2010

Related U.S. Application Data

(60) Provisional application No. 61/109,780, filed on Oct. 30, 2008.

(51) Int. Cl.

| | |
|---|---|
| ***B63H 20/00*** | (2006.01) |
| ***B63H 20/28*** | (2006.01) |
| ***B63H 21/38*** | (2006.01) |
| ***F01P 5/10*** | (2006.01) |
| ***F01P 5/12*** | (2006.01) |
| ***F01P 7/14*** | (2006.01) |

(52) U.S. Cl. ..... 440/88 C; 440/88 P; 123/41.02; 123/41.44

(58) Field of Classification Search ..... 440/88 R, 440/88 C–88 P; 123/41.01, 41.02, 41.29, 123/41.44–41.47

See application file for complete search history.

(56) References Cited

U.S. PATENT DOCUMENTS

| | | | | |
|---|---|---|---|---|
| 2,903,991 | A * | 9/1959 | Carlson et al. | 440/88 R |
| 4,728,306 | A | 3/1988 | Schneider | |
| 6,343,966 | B1 | 2/2002 | Martin et al. | |
| 6,899,575 | B1 | 5/2005 | Rothe et al. | |

FOREIGN PATENT DOCUMENTS

| | | | |
|---|---|---|---|
| JP | 61123710 | A * | 6/1986 |
| JP | 63002793 | A * | 1/1988 |
| JP | 07158443 | A * | 6/1995 |
| JP | 09088585 | A * | 3/1997 |

* cited by examiner

*Primary Examiner* — Ajay Vasudeva
(74) *Attorney, Agent, or Firm* — BCF LLP

(57) ABSTRACT

A marine outboard engine is described, having an engine disposed in a cowling. The engine has a cooling system. A first pump is disposed inside the cowling below a water line of the outboard engine. The first pump is continuously driven by the engine during operation of the engine. The first pump is a centrifugal pump having an inlet in fluid communication with an exterior of the marine outboard engine below the water line and an outlet in fluid communication with the cooling system. A second pump is disposed inside the cowling below the water line. The second pump has an inlet in fluid communication with an exterior of the marine outboard engine below the water line and an outlet in fluid communication with the cooling system. An electric motor is operatively connected to the second pump for selectively driving the second pump during operation of the engine.

8 Claims, 7 Drawing Sheets

SYSTEM AND METHOD FOR COOLING A MARINE OUTBOARD ENGINE

CROSS-REFERENCE

This application claims priority to U.S. Provisional Application No. 61/109,780, filed Oct. 30, 2009, the entirety of which is incorporated herein by reference.

FIELD OF THE INVENTION

The present invention relates to cooling systems for marine outboard engines, in particular marine outboard engines having open loop cooling systems.

BACKGROUND OF THE INVENTION

An internal combustion engine, such as those used in marine outboard engines, is powered by the combustion of fuel in one or more cylinders. During the operation of such an engine, the heat generated by the combustion of fuel in the cylinders must be dissipated to prevent overheating of the engine and consequent damage to engine components. Other components of the engine, such as fuel system, exhaust pathways, and electronics, can also experience an increase in temperature during use and require cooling to maintain normal operation.

One common method of providing cooling in marine applications is with an open loop cooling system. Water is pumped from the body of water in which the engine is operating, for example using a pump driven by either the crankshaft or the driveshaft of the engine. Referring to FIGS. 1A and 1B, one commonly used type of pump is a hybrid pump 10 that combines attributes of a centrifugal pump and a positive displacement pump. The pump 10 involves a flexible impeller 12 eccentrically mounted inside a housing 14. At low speeds (FIG. 1A), the impeller 12 is in contact with the housing 14 and the pump 10 acts as a positive displacement pump. At high speeds (FIG. 1B), the impeller 12 flexes away from the housing 14 and the pump 10 acts as a centrifugal pump. As a result, this pump design provides a flow of water over a wide range of rotational speeds, but with lower efficiency than either a displacement pump at low speeds or a centrifugal pump at high speeds. The water is pumped to one or more components that require cooling, such as a water jacket of the engine, an exhaust manifold and electronic components. The water is then returned to the body of water.

While this arrangement is adequate for cooling the engine, it has some drawbacks. The water drawn in by the pump 10 may contain salt or debris that can damage the impeller 12, for example by getting caught between the impeller 12 and the housing 14 and causing wear on the impeller 12, resulting in reduced flow of cooling water or even failure of the pump, potentially damaging the engine. In the event of damage to the pump 10, the pump is often difficult to access and service because it is typically located above the cavitation plate of the engine so that it can be conveniently driven by the crankshaft or driveshaft. In addition, while the pump 10 is operational at all speeds, it may not provide a sufficient flow of water for adequate cooling, particularly at very low speeds when the speed of the pump 10 may not be sufficient to deliver the required volume of cooling water, and at very high speeds when the pump 10 experiences reduced efficiency. One alternative design, a centrifugal pump, is less susceptible to wear but provides insufficient cooling at low speeds.

Therefore, there is a need for a method of providing improved cooling to a marine engine over a wide range of engine speeds.

There is also a need for a marine engine having improved cooling over a wide range of engine speeds.

There is also a need for a pump assembly requiring low maintenance and being easy to service and repair.

SUMMARY OF THE INVENTION

It is an object of the present invention to ameliorate at least some of the inconveniences present in the prior art.

In one aspect, the invention provides a method of cooling a marine outboard engine, the marine outboard engine comprising a cowling. An engine is disposed in the cowling. The engine has a cooling system. A driveshaft is disposed generally vertically. The driveshaft has a first end and a second end. The first end of the driveshaft is operatively connected to the engine. A gear case is disposed generally below the engine. Water is continuously pumped during operation of the engine from a body of water to the cooling system using a first centrifugal pump operatively connected to the engine and disposed below a water line of the outboard engine. Water is selectively pumped during operation of the engine from a body of water to the cooling system using a second pump operatively connected to an electric motor and disposed below the water line in response to at least one of: a current engine temperature being above a predetermined threshold temperature; a current engine speed being below a predetermined threshold engine speed; and a current speed of a watercraft to which the marine outboard engine is attached being above a predetermined threshold speed. Water is delivered from the cooling system to the body of water.

In a further aspect, selectively pumping the water using the second pump includes selectively pumping the water to an outlet of the second pump in fluid communication with an outlet of the first pump and upstream of the cooling system.

In a further aspect, the first pump is primed using the second pump upon starting the engine.

In a further aspect, selectively the pumping water using the second pump includes pumping water using the second pump only in response to a current engine speed being below a predetermined threshold speed.

In a further aspect, the predetermined threshold speed is 1500 RPM.

In a further aspect, pumping the water using the first pump to the cooling system includes pumping the water using the first pump to a water jacket of the engine. Selectively pumping the water using the second pump to the cooling system includes pumping the water using the second pump to the water jacket of the engine.

In an additional aspect, the invention provides a marine outboard engine, comprising a cowling. An engine is disposed in the cowling. The engine has a cooling system. A driveshaft is disposed generally vertically. The driveshaft has a first end and a second end. The first end of the driveshaft is operatively connected to the engine. A gear case is disposed generally below the engine. A propeller shaft is disposed in the gear case and operatively connected to the second end of the driveshaft. A propeller mounted to the propeller shaft. A first pump is disposed inside the cowling below a water line of the outboard engine. The first pump is continuously driven by the engine during operation of the engine. The first pump is a centrifugal pump having an inlet in fluid communication with an exterior of the marine outboard engine below the water line and an outlet in fluid communication with the cooling system. A second pump is disposed inside the cowling below the water line. The second pump has an inlet in fluid communication with an exterior of the marine outboard engine below the water line and an outlet in fluid communication with the cooling system. An electric motor is operatively connected to the second pump for selectively driving the second pump during operation of the engine.

In a further aspect, the electric motor drives the second pump when a current engine temperature is above a predetermined threshold engine temperature.

In a further aspect, the electric motor drives the second pump when a current rotational speed of the engine is below a predetermined threshold rotational speed.

In a further aspect, the outlet of the first pump fluidly communicates with the outlet of the second pump at a point upstream of the cooling system.

In a further aspect, a cavitation plate is disposed generally above the gear case. The outlet of the first pump fluidly communicates with the outlet of the second pump above the cavitation plate.

In a further aspect, the first and second pumps are self-priming pumps.

In a further aspect, the first pump is driven by the propeller shaft.

In a further aspect, the inlet of the first pump fluidly communicates with the front of the gear case.

In this application, the term "water line" refers to the water level with respect to an outboard engine when the outboard engine is mounted on a watercraft with the drive shaft oriented vertically and the watercraft is at rest.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1A:
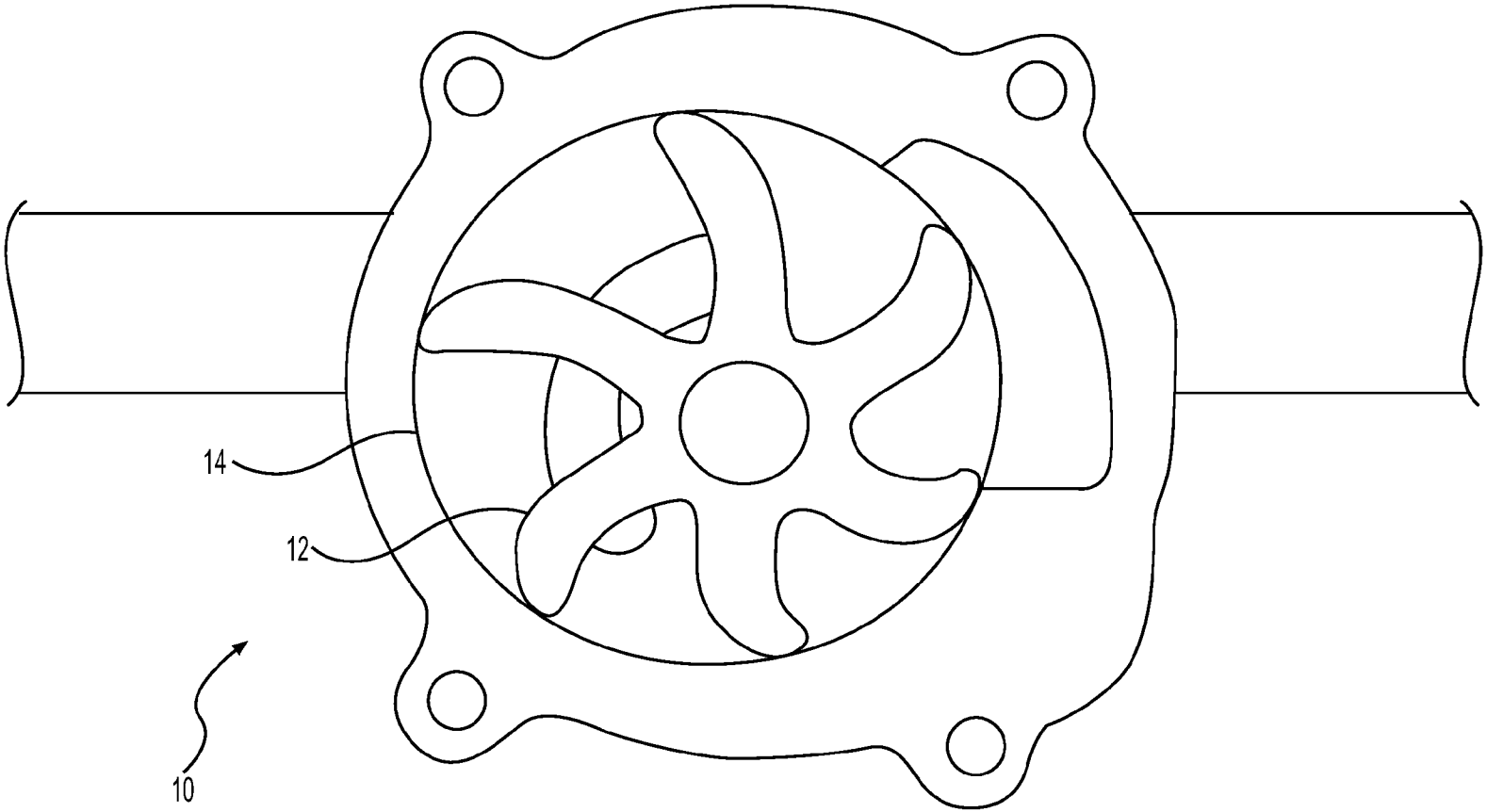
FIG. 1A PRIOR ART
FIGS. 1A and 1B are cross-sectional views of a prior art pump, operating at low and high speeds respectively.
Figure 1B:
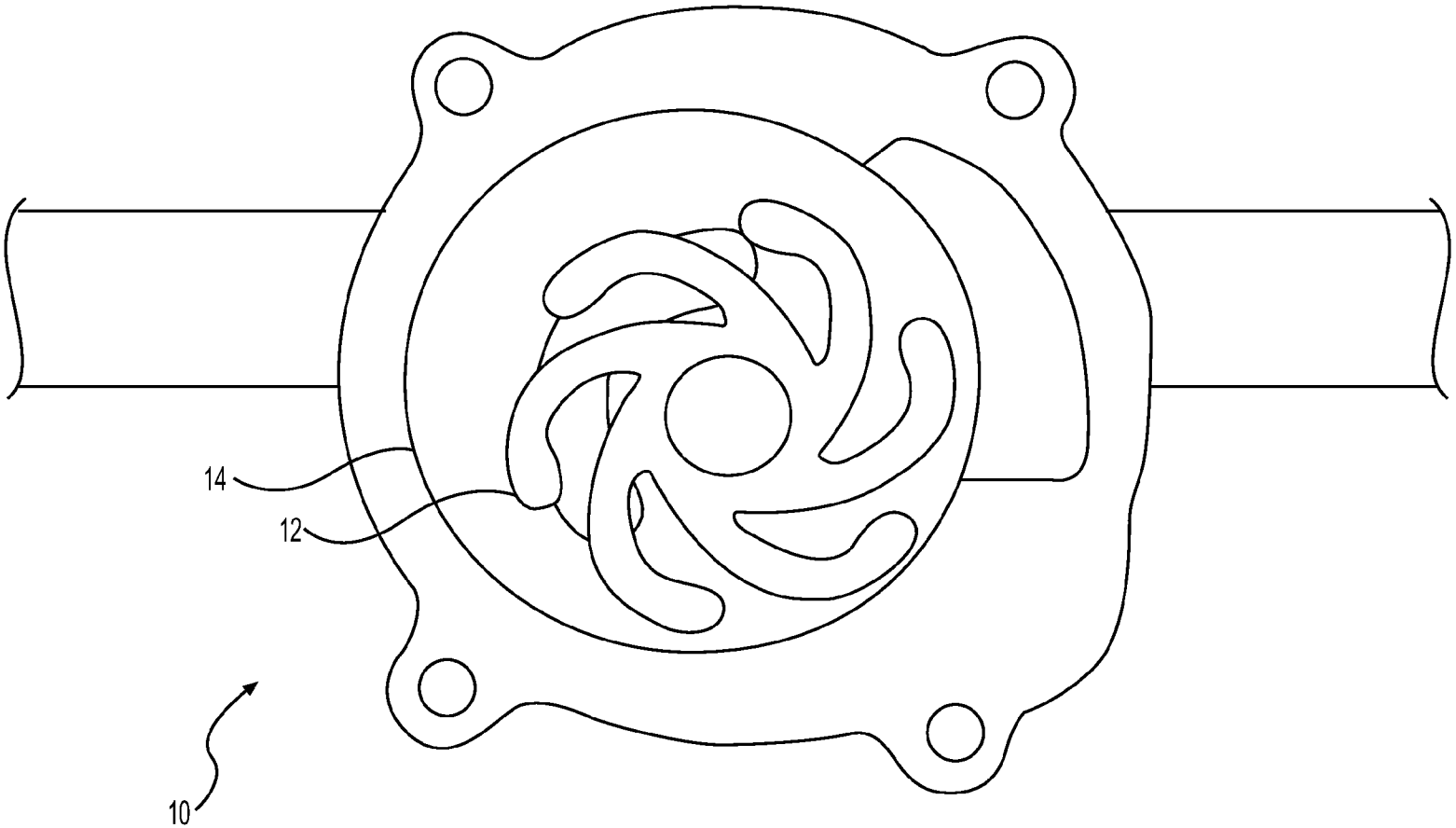
FIG. 1B PRIOR ART
Figure 2:
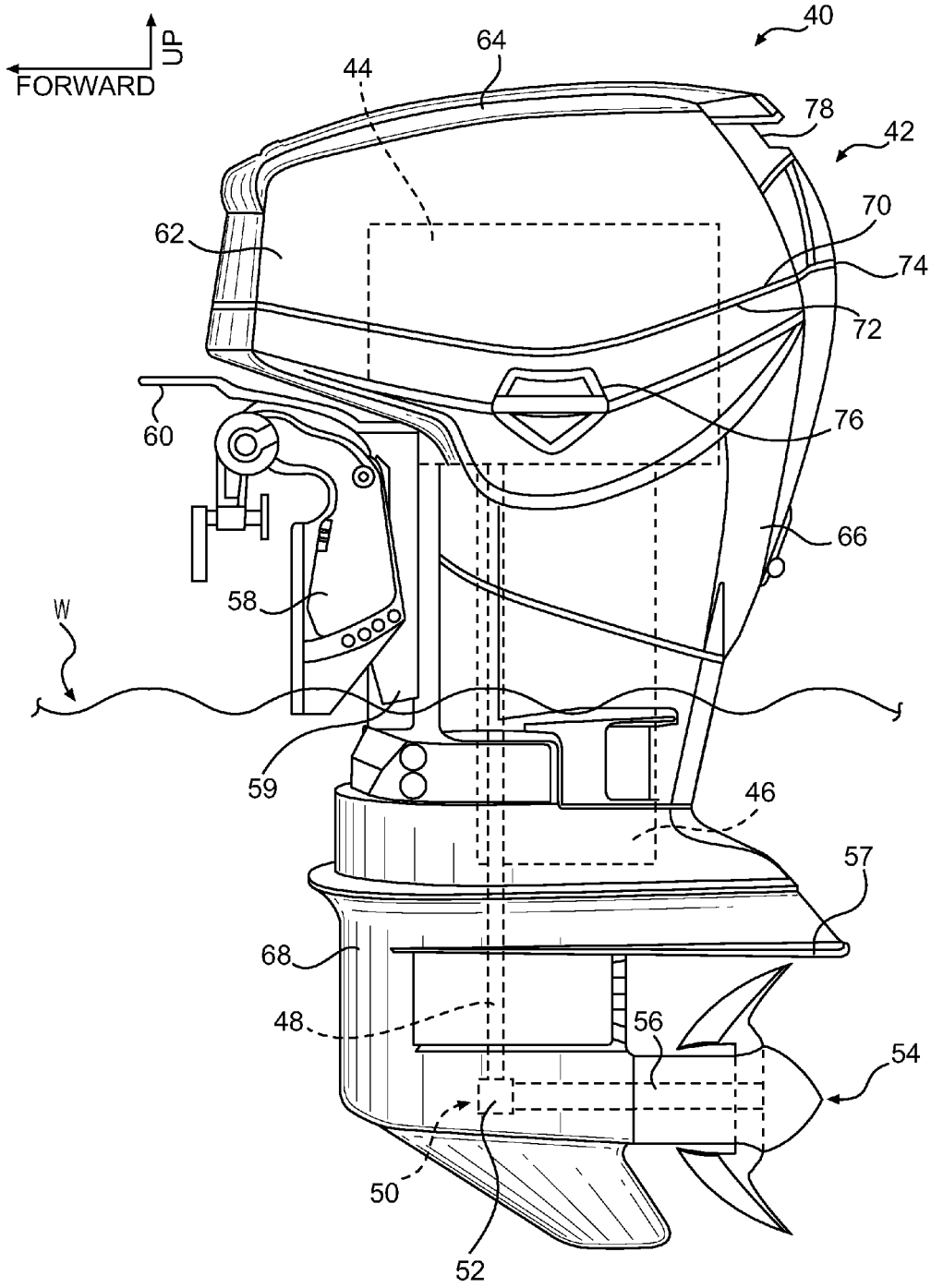
FIG. 2 is a side elevation view of a marine outboard engine to which the present invention can be applied.

Referring to FIG. 2, a marine outboard engine 40 will be described to which the present invention can be applied. It should be understood that the present invention is applicable to other marine applications, such as inboard engines and stern drives.

FIG. 2 is a side view of a marine outboard engine 40 having a cowling 42. The cowling 42 surrounds and protects an engine 44, shown schematically. The engine 44 may be any suitable engine known in the art, such as an internal combustion engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller assembly 54 (shown schematically) mounted on a propeller shaft 56. The propeller shaft 56 is generally perpendicular to the driveshaft 48. A cavitation plate 57, disposed generally above the gear case 68 and below the water line W, extends above the propeller assembly 54 to prevent air above the surface of the water from entering the flow of water in the vicinity of the propeller assembly 54 and potentially damaging the propeller assembly 54.

Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via a swivel bracket 59 for mounting the outboard engine 40 to a watercraft. The stern bracket 58 and swivel bracket 59 can take various forms, the details of which are conventionally known.

A linkage 60 is operatively connected to the cowling 42, to allow steering of the outboard engine 40 when coupled to a steering mechanism of a boat, such as a steering wheel.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 42.

The upper motor cover 62 is formed with two parts, but could also be a single cover. As seen in FIG. 2, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 3:
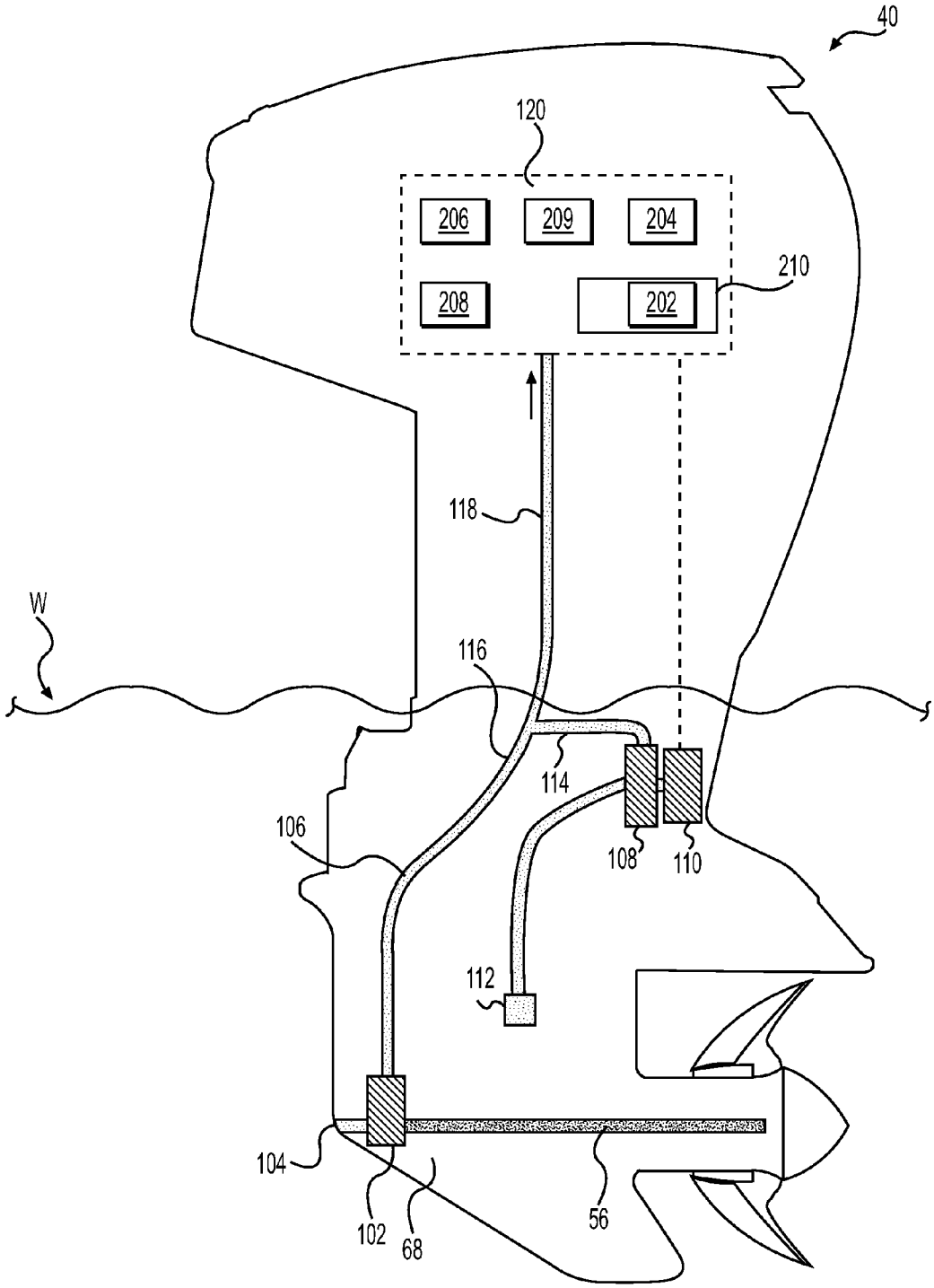
FIG. 3 is a side elevation view of a marine outboard engine showing a pump assembly according to a first embodiment.

Referring now to FIG. 3, the water pump arrangement of the outboard engine 40 will be described according to a first embodiment.

A primary water pump, in the form of a centrifugal pump 102, is disposed in the gear case 68. The pump 102 is driven by the rotation of the propeller shaft 56. It is contemplated that the axis of the pump 102 may be offset from the axis of the propeller shaft 56, with a gear reduction arrangement (not shown) disposed therebetween. As a result, the pump 102 is in continuous operation when the engine 44 is in operation. In order to maintain the continuous operation of the pump 102, it is preferable for the propeller assembly 54 to be a variable pitch propeller assembly such as the one described in U.S. patent application Ser. No. 11/962,372, which is incorporated herein by reference in its entirety. This variable pitch propeller assembly allows the outboard engine 40 to provide thrust in either the forward or the reverse direction, as well as a neutral position, without reversing the direction of rotation of the propeller shaft 56 or disengaging the propeller shaft 56 from the engine 44. It is contemplated that continuous operation of the pump 102 may alternatively be provided in other ways, which will be described below in further detail. The pump 102 draws water from the surrounding body of water through a primary inlet 104, preferably located at the front of the gear case 68. The pump 102 pumps the water upwardly through the primary outlet 106, toward the cooling system 120 of the engine 44.

An auxiliary water pump, in the form of a positive displacement pump 108, is also disposed in the gear case 68. Alternative positions of the pump 108 are also contemplated, and will be described below with reference to alternative embodiments. The pump 108 is driven by an electric motor 110, which is controlled by an electronic control unit ("ECU") 202 of the engine 44. The ECU 202 preferably causes the pump 108 to operate at times when the pump 102 is either expected or observed to provide insufficient water flow. The pump 108 may be caused to operate when the engine is operating at low speeds, preferably below 1500 RPM, when the pump 102 experiences reduced efficiency. The pump 108 may also be caused to operate when the watercraft is traveling at a speed below a predetermined threshold speed, such as below 5 miles per hour, including when the engine is in a neutral or reverse mode, when the pump 102 may not provide enough water to cool the engine. The pump 108 may also be caused to operate when an elevated temperature is detected by the ECU 202, indicating the need for additional cooling. The pump 108 may also be caused to operate at engine startup, as will be described below in further detail. When the pump 108 is in operation, the pump 108 draws water from the surrounding body of water through the auxiliary inlet 112, and pumps the water upward through the auxiliary outlet 114. In conditions when the pump 102 would normally provide adequate cooling for the engine 44, such as during cruising at high speeds, the ECU 202 does not cause the pump 108 to operate, and water is supplied to the cooling system 120 only by the pump 102. It is contemplated that the pump 108 may include a check valve (not shown) to prevent water flow from the outlet 106 into the outlet 114 and out of the engine via the inlet 112 without first passing through the cooling system 120. It is contemplated that the pump 108 may alternatively operate at all times when the engine 44 is operating.

The outlets 106, 114 of the pumps 102, 108 fluidly communicate at a point 116 located above the cavitation plate 57, and extend upwardly from the point 116 via a common conduit 118. In this configuration, the pump 108 can be operated at engine startup to prime the pump 102 by pumping water to the point 116, which then descends via the primary outlet 106 toward the pump 102 to fill the pump 102 with water. It is contemplated that the pump 102 may alternatively be self-priming, in which case the pump 102 may include a check valve (not shown) to prevent water flow from the outlet 114 into the outlet 106 and out of the engine via the inlet 104 without first passing through the cooling system 120. The conduit 118 supplies water to a cooling system 120 (shown schematically) of the engine 44. The cooling system 120 may include water passageways arranged to cool one or more components of the engine 44 that either generate heat or require cooling due to the heat generated by surrounding components. Components for which the cooling system 120 provides cooling may include the engine 44 via a water jacket 204, the exhaust manifold 206 of the engine 44, one or more fuel injectors or carburetors 208 that supply fuel to the engine 44, a lubrication system 209 of the engine 44, and or one or more electronic systems 210 such as the ECU 202 that are electrically connected to the engine 44. After the water from the conduit 118 has cooled one or more components of the cooling system 120, the water is returned to the body of water via an outlet (not shown) in a known manner.

Figure 4:
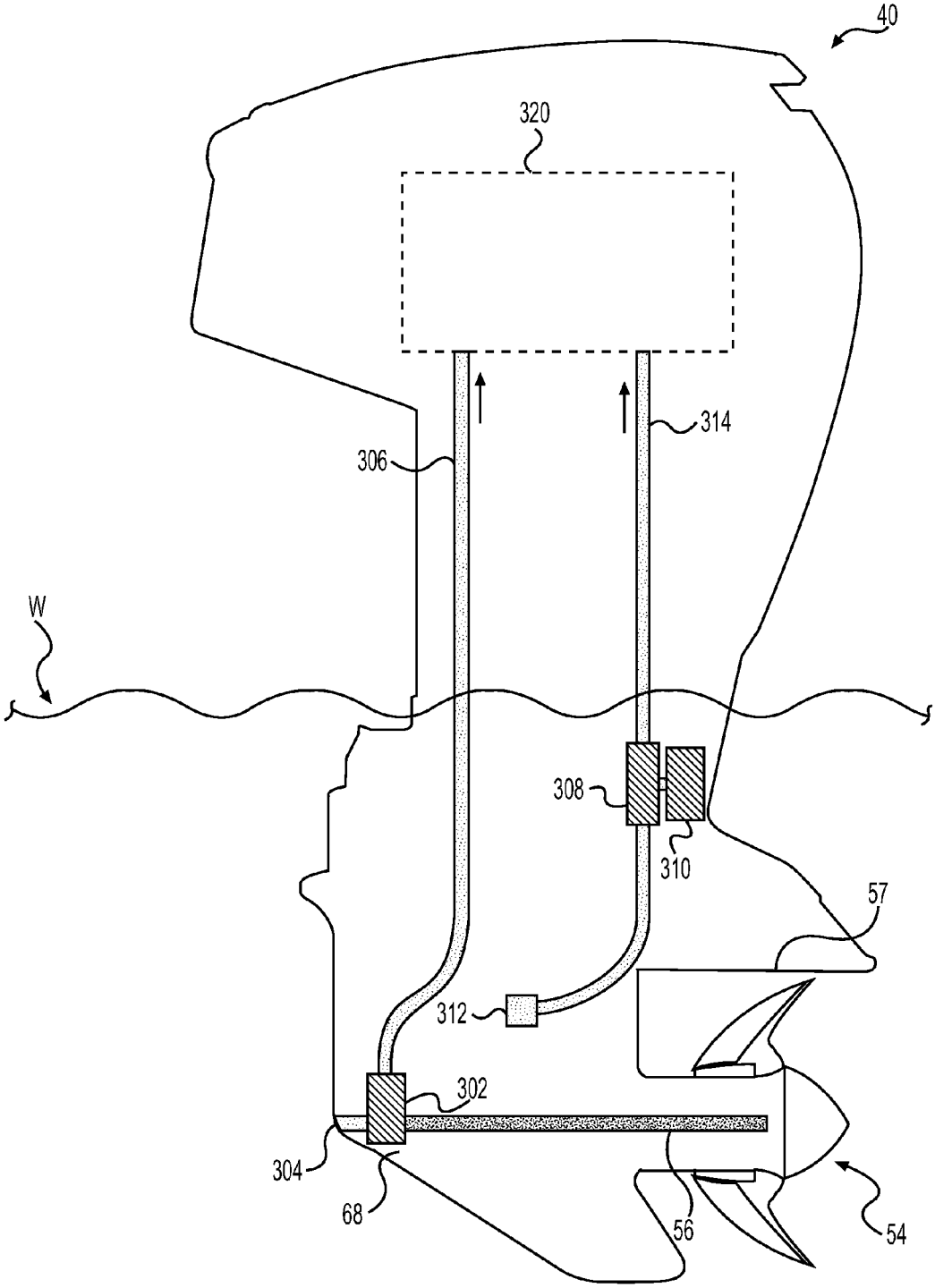
FIG. 4 is a side elevation view of a marine outboard engine showing a pump assembly according to a second embodiment.

Referring now to FIG. 4, the water pump arrangement of the outboard engine 40 will be described according to a second embodiment.

A primary water pump, in the form of a centrifugal pump 302, is disposed in the gear case 68. The pump 302 is driven by the rotation of the propeller shaft 56, similarly to the pump 102 of FIG. 3. The pump 302 draws water from the surrounding body of water through a primary inlet 304, preferably located at the front of the gear case 68. The pump 302 pumps the water upward through the primary outlet 306 toward the cooling system 320 (shown schematically) of the engine 44.

An auxiliary water pump, in the form of a positive displacement pump 308, is disposed above the cavitation plate 57 and below the water line W. The pump 308 is driven by an electric motor 310, which is controlled by the ECU 202. The ECU 202 controls the pump 308 in a similar way to the auxiliary pump 108 of FIG. 3. When the pump 308 is in operation, the pump 308 draws water from the surrounding body of water through the auxiliary inlet 312, and pumps the water upward through the auxiliary outlet 314.

In this embodiment, the outlets 306, 314 of the pumps 302, 308 do not fluidly communicate upstream of the cooling system 320 (shown schematically) of the engine 44. In this embodiment, it is preferred that the pumps 302, 308 both be self-priming pumps. Each outlet 306, 314 supplies a separate flow of water to the cooling system 320. The cooling system 320 includes the same components as the cooling system 120 of FIG. 3, and as such will not be described again in detail. After the water from either or both of the outlets 306, 314 has cooled one or more components of the cooling system 320, the water is returned to the body of water via an outlet (not shown) in a known manner.

Figure 5:
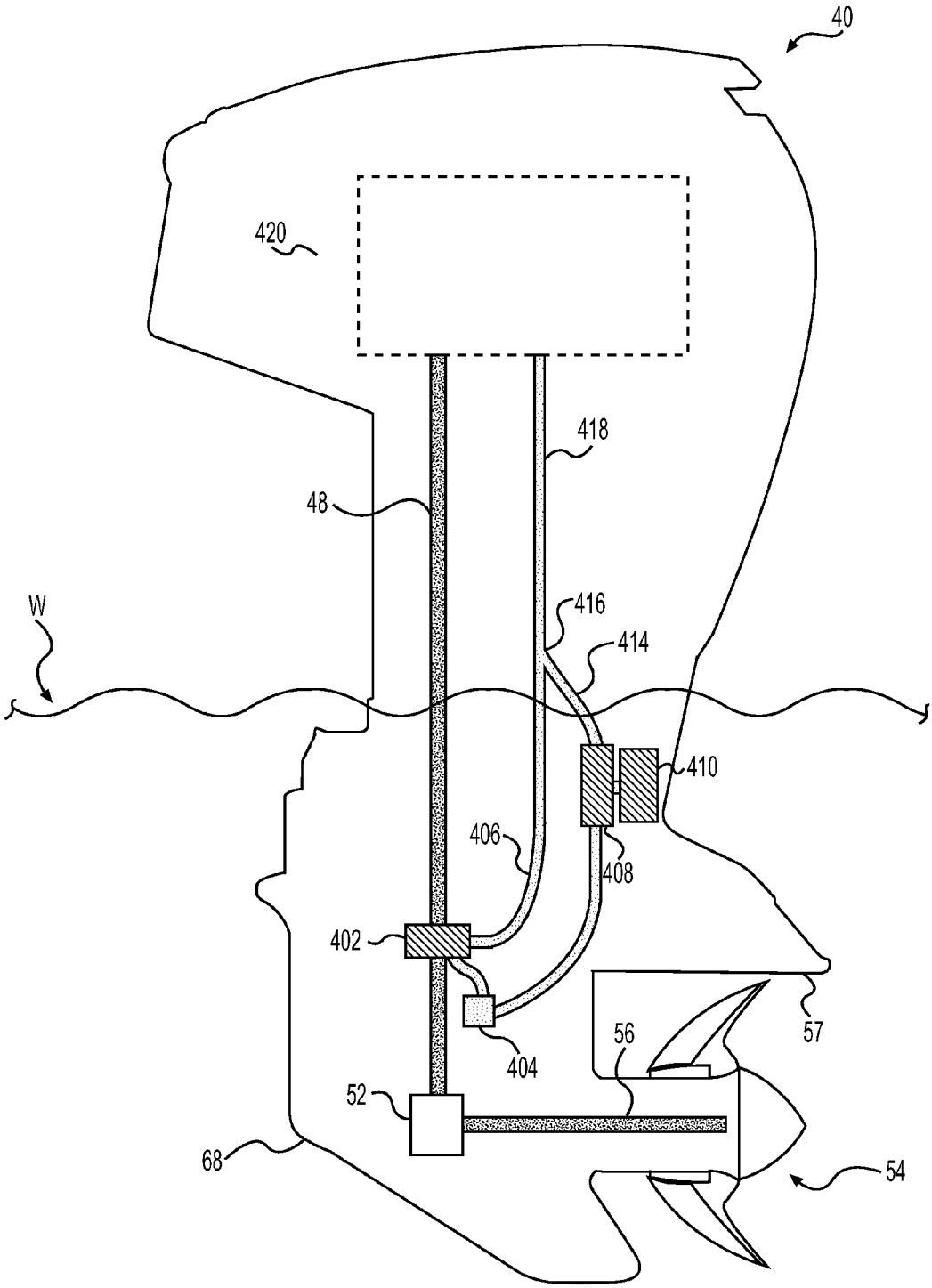
FIG. 5 is a side elevation view of a marine outboard engine showing a pump assembly according to a third embodiment.

Referring now to FIG. 5, the water pump arrangement of the outboard engine 40 will be described according to a third embodiment.

A primary water pump, in the form of a centrifugal pump 402, is disposed above the cavitation plate 57 and below the water line W. The pump 402 is disposed around the drive shaft 48 and is driven by the rotation of the drive shaft 48. It is contemplated that the pump 402 may be driven by a gear reduction arrangement, in which case the axis of the pump 402 may be offset from the axis of the drive shaft 48. In this arrangement, the pump 402 remains in continuous operation while the engine 44 is in operation, even if the drive shaft 48 is disengaged from the propeller assembly 54 or the direction of rotation of the propeller shaft 56 is reversed by the transmission 52 disposed in the gear case 68. The pump 402 draws water from the surrounding body of water through an inlet 404 disposed in the gear case 68. The pump 402 pumps the water upward through the primary outlet 406 toward the cooling system 420 (shown schematically) of the engine 44.

An auxiliary water pump, in the form of a positive displacement pump 408, is disposed above the cavitation plate 57 and below the water line W. The pump 408 is driven by an electric motor 410, which is controlled by the ECU 202. The ECU 202 controls the pump 408 in a similar way to the auxiliary pump 108 of FIG. 3. When the pump 408 is in operation, the pump 408 draws water from the surrounding body of water through the inlet 404, and pumps the water upward through the auxiliary outlet 414.

The outlets 406, 414 of the pumps 402, 408 fluidly communicate at a point 416 located above the cavitation plate 57, and extend upwardly from the point 416 via a common conduit 418. In this configuration, the pump 408 can be operated at engine startup to prime the pump 402 in the same manner as the pump 108 of FIG. 3. The conduit 418 supplies water to the cooling system 420 (shown schematically) of the engine 44. The cooling system 420 includes the same components as the cooling system 220 of FIG. 3, which will not be described again in detail. After the water from the conduit 418 has cooled one or more components of the cooling system 420, the water is returned to the body of water via an outlet (not shown) in a known manner.

Figure 6:
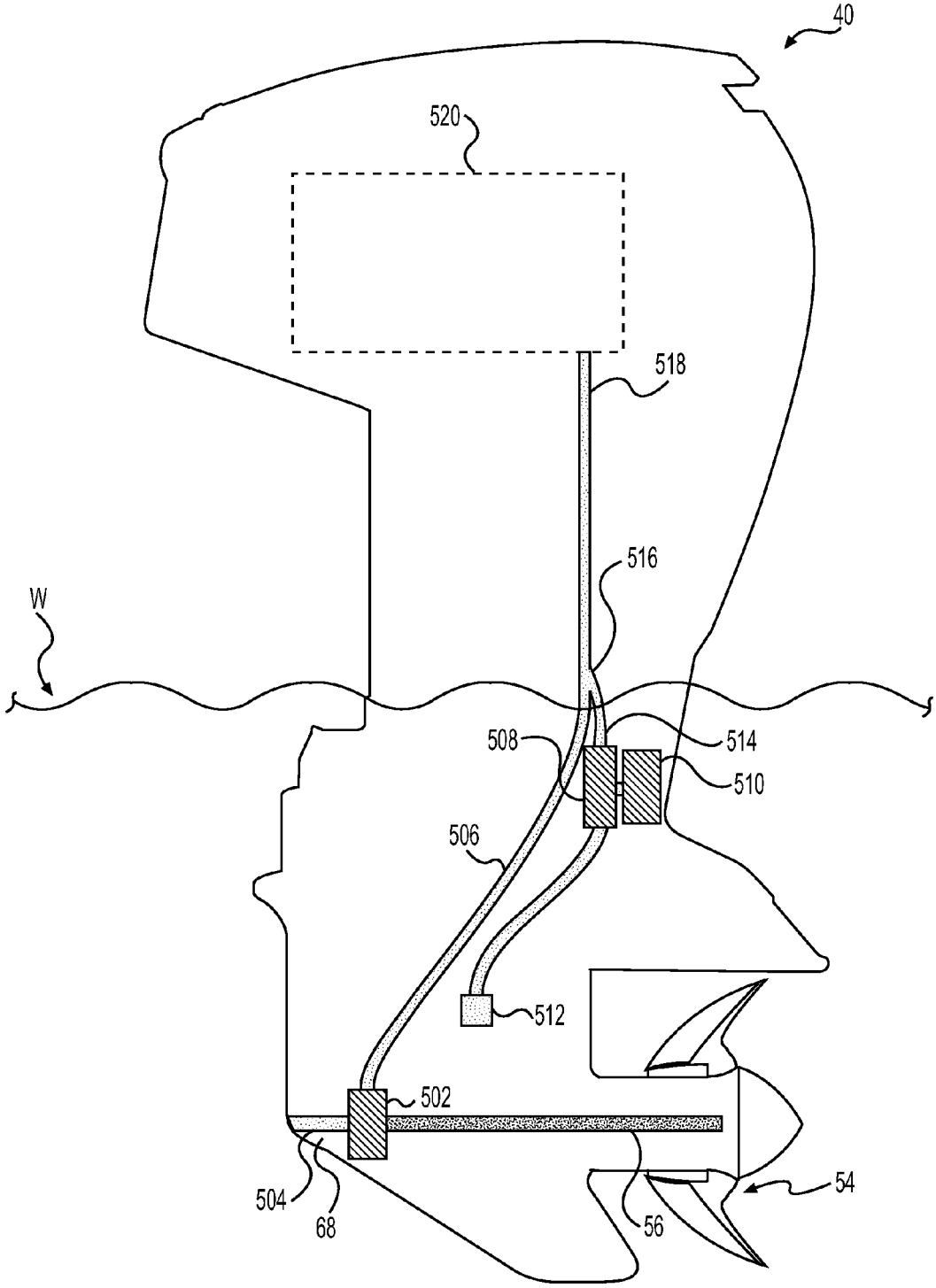
FIG. 6 is a side elevation view of a marine outboard engine showing a pump assembly according to a fourth embodiment.

Referring now to FIG. 6, the water pump arrangement of the outboard engine 40 will be described according to a fourth embodiment.

A primary water pump, in the form of a centrifugal pump 502, is disposed in the gear case 68. The pump 502 is driven by the rotation of the propeller shaft 56, similarly to the pump 102 of FIG. 3. The pump 502 draws water from the surrounding body of water through a primary inlet 504, preferably located at the front of the gear case 68. The pump 502 pumps the water upward through the primary outlet 506 toward the cooling system 520 (shown schematically) of the engine 44.

An auxiliary water pump, in the form of a positive displacement pump 508, is disposed above the cavitation plate 57 and below the water line W. The pump 508 is driven by an electric motor 510, which is controlled by the ECU 202. The ECU 202 controls the pump 508 in a similar way to the auxiliary pump 108 of FIG. 3. When the pump 508 is in operation, the pump 508 draws water from the surrounding body of water through the auxiliary inlet 512, and pumps the water upward through the auxiliary outlet 514.

The outlets 506, 514 of the pumps 502, 508 fluidly communicate at a point 516 located above the cavitation plate 57, and extend upwardly from the point 516 via a common conduit 518. In this configuration, the pump 508 can be operated at engine startup to prime the pump 502 in the same manner as the pump 108 of FIG. 3. The conduit 518 supplies water to the cooling system 520 (shown schematically) of the engine 44. The cooling system 520 includes the same components as the cooling system 220 of FIG. 3, and as such will not be described again in detail. After the water from the conduit 518 has cooled one or more components of the cooling system 520, the water is returned to the body of water via an outlet (not shown) in a known manner.

Using any one of the above arrangements, an ample and uniform flow of cooling water can be delivered to the cooling system 220 under a wide range of conditions. In the arrangement shown in FIG. 3, the pump 102 is a centrifugal pump having an impeller (not shown) with rigid vanes rotatably mounted within a housing (not shown). This pump design provides more efficient cooling at high speeds than the conventional hybrid pump 10, and the auxiliary pump 108 supplements the cooling at lower speeds. The auxiliary pump 108 does not experience reduced efficiency at low speeds, because it is powered by the electric motor 110 at a speed independent of the rotational speed of the engine 44. In addition, the pump 102 is more durable than the pump 10 because the vanes of the pump 102 do not contact the housing and are therefore not subject to the same degree of wear. In addition, the vanes of the pump 102 are more resistant to corrosion or damage due to salt or debris entering the pump housing than the flexible impeller 12 of the pump 10. In the event of damage or wear, the location of the pump 102 in the gear case 68 permits easy access for servicing or replacement. In addition, the useful life of the auxiliary pump 108 is extended, and its maintenance requirements correspondingly reduced, by using the auxiliary pump 108 only when needed to supplement the flow of cooling water from the pump 102, rather than constantly while the engine 44 is in operation. Similar advantages are provided by the embodiments shown in FIGS. 4, 5 and 6.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine, comprising:

a cowling;

an engine disposed in the cowling, the engine having a cooling system;

a driveshaft disposed generally vertically, the driveshaft having a first end and a second end, the first end of the driveshaft being operatively connected to the engine;

a gear case disposed generally below the engine;

a propeller shaft disposed in the gear case and operatively connected to the second end of the driveshaft;

a propeller mounted to the propeller shaft;

a first pump disposed inside the cowling below a water line of the outboard engine, the first pump being continuously driven by the engine during operation of the engine, the first pump being a centrifugal pump having an inlet in fluid communication with an exterior of the marine outboard engine below the water line and an outlet in fluid communication with the cooling system; and a second pump disposed inside the cowling below the water line, the second pump having an inlet in fluid communication with an exterior of the marine outboard engine below the water line and an outlet in fluid communication with the cooling system, an electric motor operatively connected to the second pump for selectively driving the second pump during operation of the engine.

2. The marine outboard engine of claim 1, wherein the electric motor drives the second pump when a current engine temperature is above a predetermined threshold engine temperature.

3. The marine outboard engine of claim 1, wherein the electric motor drives the second pump when a current rotational speed of the engine is below a predetermined threshold rotational speed.

4. The marine outboard engine of claim 1, wherein the outlet of the first pump fluidly communicates with the outlet of the second pump at a point upstream of the cooling system.

5. The marine outboard engine of claim 4, further comprising a cavitation plate disposed generally above the gear case; wherein the outlet of the first pump fluidly communicates with the outlet of the second pump above the cavitation plate.

6. The marine outboard engine of claim 1, wherein the first and second pumps are self-priming pumps.

7. The marine outboard engine of claim 1, wherein the first pump is driven by the propeller shaft.

8. The marine outboard engine of claim 1, wherein the inlet of the first pump fluidly communicates with the front of the gear case.

* * * * *